US007383755B1

(12) United States Patent
Kang

(10) Patent No.: US 7,383,755 B1
(45) Date of Patent: Jun. 10, 2008

(54) TOOL SET

(76) Inventor: Hsin Fa Kang, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/607,966

(22) Filed: Dec. 4, 2006

(51) Int. Cl.
*B25B 23/00* (2006.01)

(52) U.S. Cl. ..... 81/440; 81/436; 81/439

(58) Field of Classification Search ..... 81/436, 81/439, 440
See application file for complete search history.

(56) References Cited

U.S. PATENT DOCUMENTS 6,233,769 B1 * 5/2001 Seber et al. ..... 7/128
6,868,760 B1 * 3/2005 Johnson ..... 81/440
7,146,889 B2 * 12/2006 Kang ..... 81/437

* cited by examiner

*Primary Examiner*—Joseph J. Hail, III
*Assistant Examiner*—Shantese L McDonald

(57) ABSTRACT

A tool set includes two grips installed with a tool-mounting rod and a positioning member between. The tool-mounting rod is pivotally linked with plural tools. Each of the grips has a through hole for a projecting bar respectively projected at two ends of the positioning member. The positioning member has plural jags, slopes and restricting grooves. One of the projecting bars is mounted with a spring. In using, choose a tool and swing it up to lean on the slope, and then, press down the tool to move against the slope to enter the restricting groove. Then the spring is to elastically push the positioning member back to its original position, keeping the tool restricted in the restricting groove immovably for operating it safely.

5 Claims, 7 Drawing Sheets

TOOL SET

BACKGROUND OF THE INVENTION

1. Field of the Invention

This invention relates to a tool set, particularly to one that can be operated stably and folded up quickly for carrying around.

2. Description of the Prior Art

Commonly, as shown in FIG. 1, a conventional portable tool set 1 consists of two grips respectively provided with a pivotal connecting rod 11 at their two ends for pivotally linking with various tools 12. Each of the tools 12 is provided with a mounting hole 120 at its one end, able to be swung out for using and swung in for storing. But, it is obvious that the tools 12 are not kept immovable while they are rotated out for practical operation, letting them apt to swing or slide further so that the hand of a user may easily get hurt.

SUMMARY OF THE INVENTION

The objective of this invention is to offer a tool set.

The main characteristics of the invention are two grips and a positioning member. A tool-mounting rod is connected between the grips for mounting with plural tools. The grips are respectively provided with a penetrating hole at their one end. The positioning member installed between the grips is provided with a projecting bar at its two ends respectively for fitting in the penetrating hole. In addition, the positioning member is also provided with plural jags, a slope located in front of each of the jags and a restricting groove recessed sideward from each of the jag. There is a spring mounted on one of the projecting bars of the positioning member.

BRIEF DESCRIPTION OF DRAWINGS

This invention is better understood by referring to the accompanying drawings, wherein.

DETAILED DESCRIPTION OF THE PREFERRED EMBODIMENT

Figure 1:
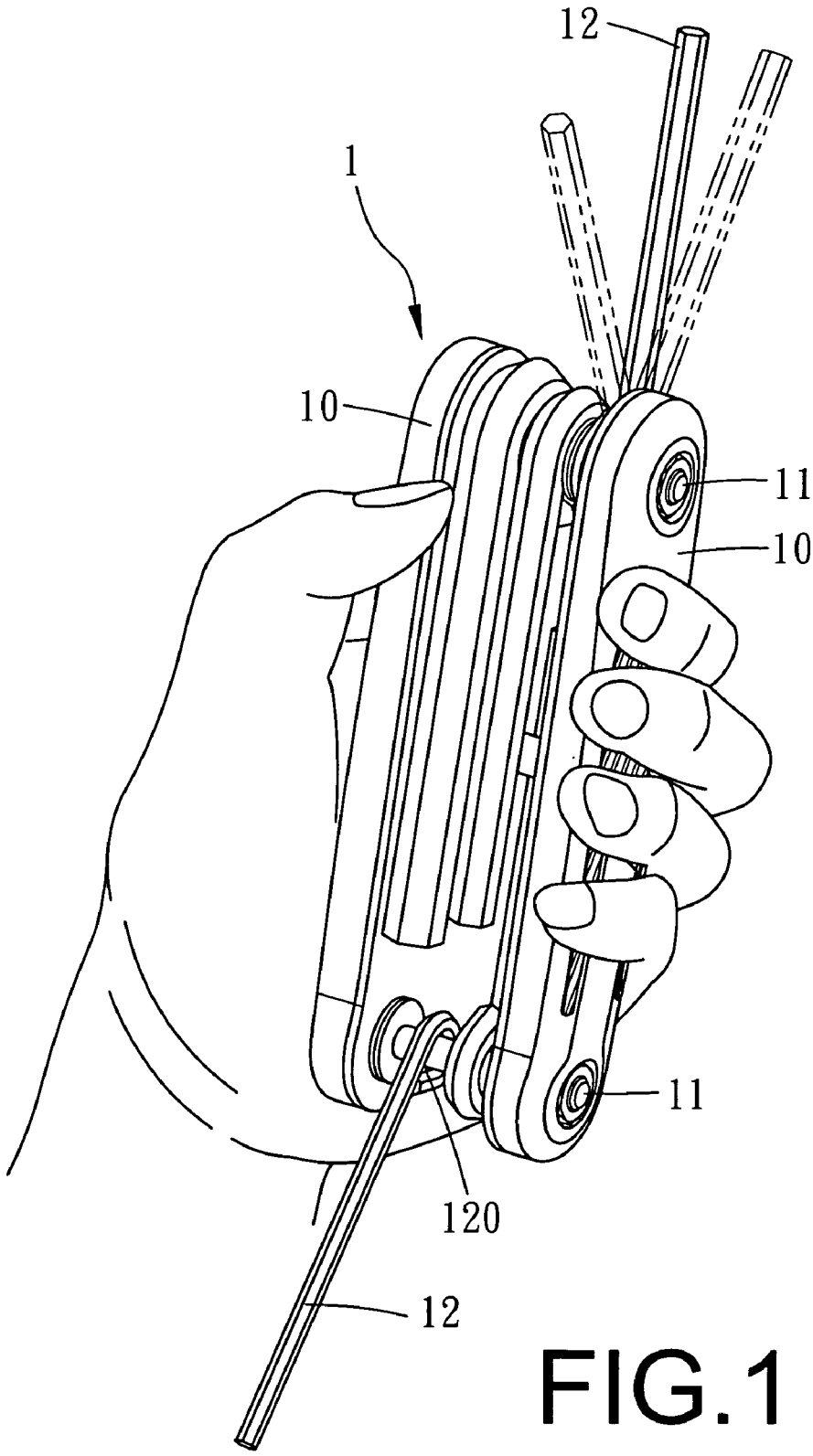
FIG.1 (PRIOR ART)
FIG. 1 is a perspective view of a conventional tool set, showing it being operated.
Figure 2:
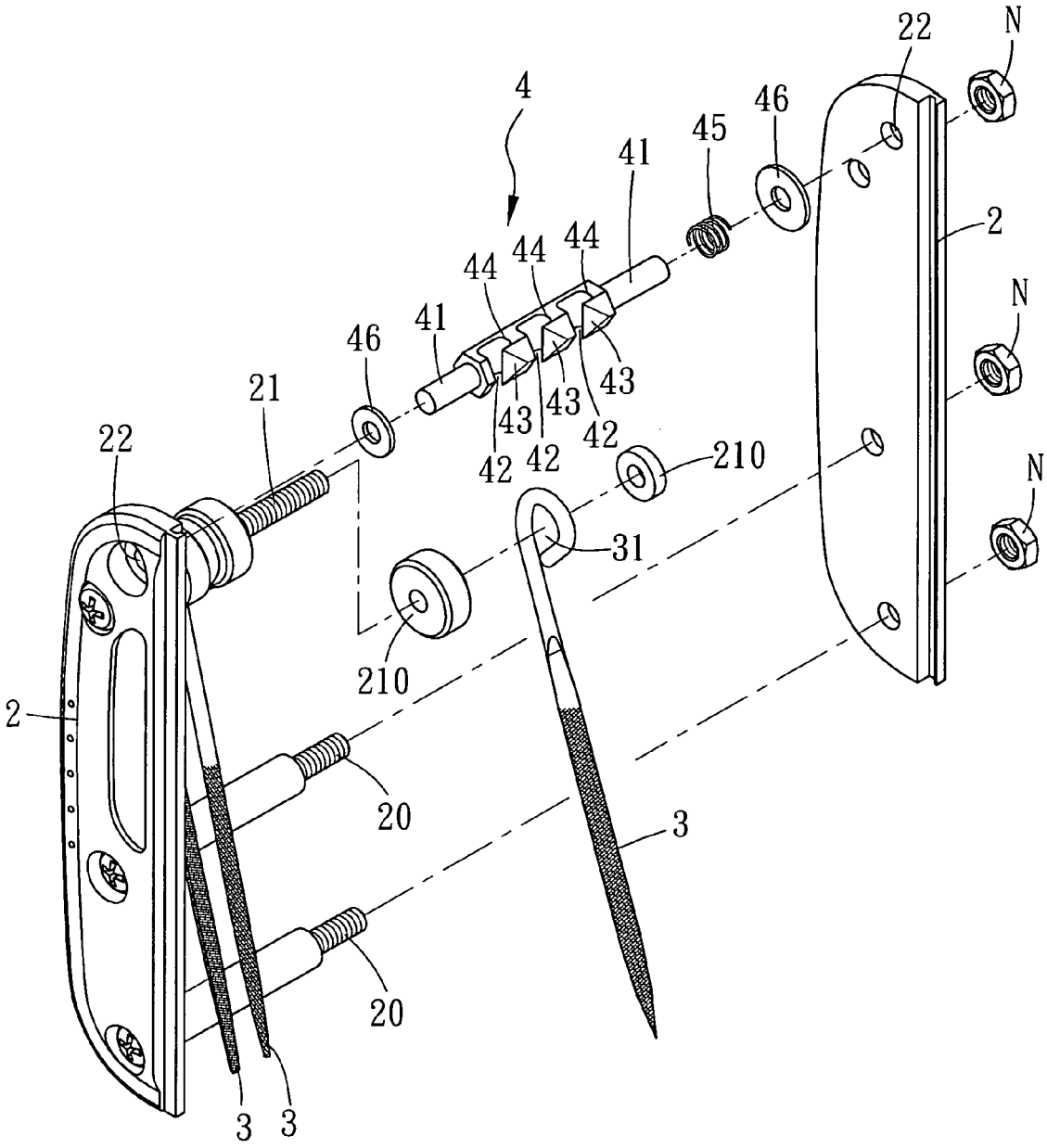
FIG. 2 is an exploded perspective view of a preferred embodiment of a tool set in the present invention.

As shown in FIG. 2, a preferred embodiment of a tool set in the present invention consists of a couple of grips 2, plural different tools 3 and a positioning member 4. The grips 2 are spaced apart through connecting with two connecting rods 20 and a tool-mounting rod 21, fixed by means of nuts N. The tool-mounting rod 21 is mounted with the tools 3 by means of a pivotal connecting portion 31 respectively provided at their one end. The tool-mounting rod 21 is provided with plural washers 210 respectively installed between each inner wall of the grips 2 and the tools 3 located outermost, and between every two adjacent tools 3. Each of the grips 2 is provided with a through hole 22 at its one end.

The positioning member 4 installed between the grips 2 is provided with a projecting bar 41 at its two ends respectively for fitting in the through holes 22 of the grips 2, plural jags 42 and a slope 43 located in front of each of the jags 42. There is a restricting groove 44 recessed rightward from each of the jags 42. One of the projecting bars 41 is mounted with a spring 45. In addition, a washer 46 is mounted outermost on each of the projecting bars 41 of the positioning member 4.

Figure 3:
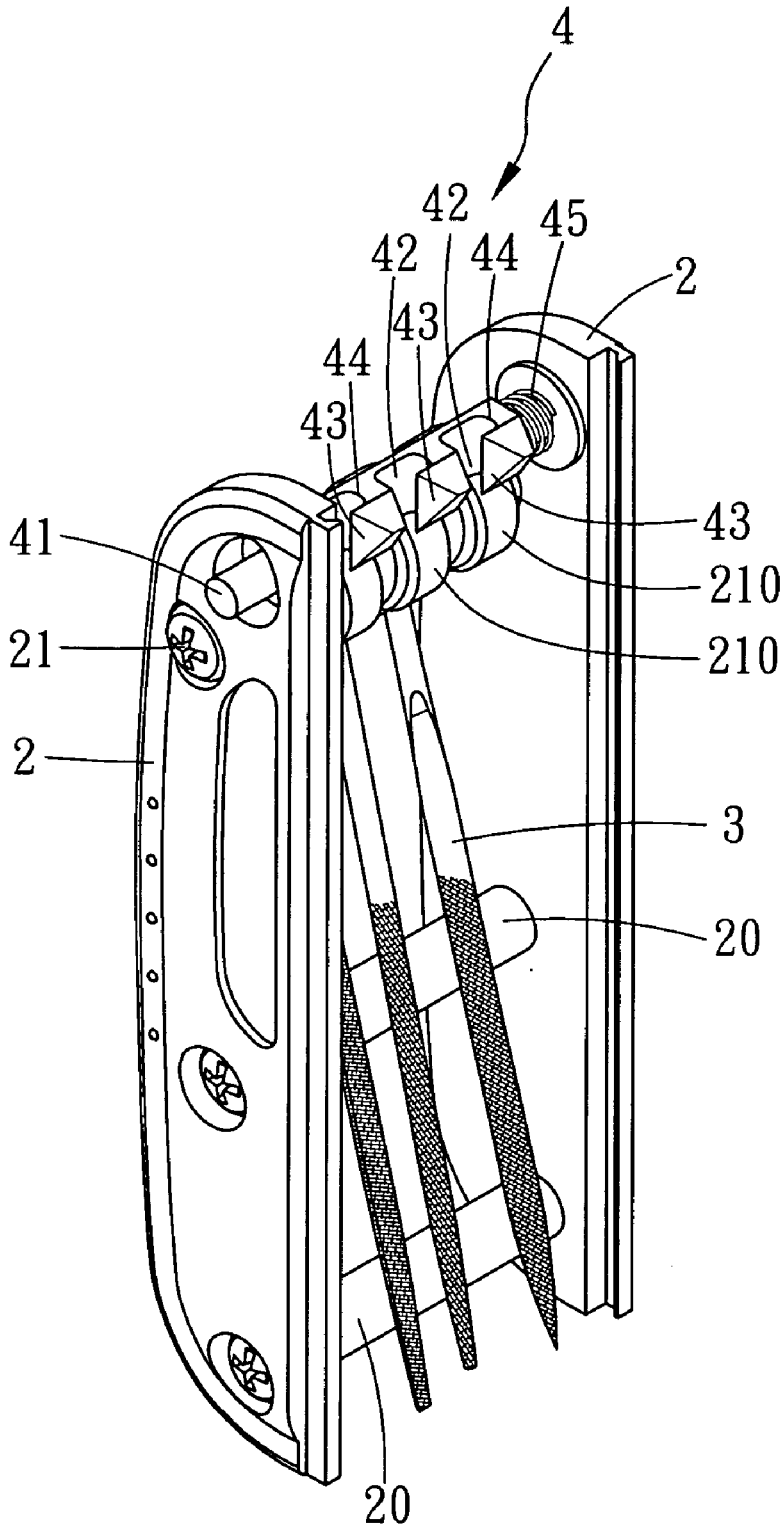
FIG. 3 is a perspective view of the preferred embodiment of a tool set in the present invention.

In assembly, as shown in FIGS. 2 and 3, insert the connecting rods 20 and the tool-mounting rod 21 into one of the grips 2 and put the pivotal connecting portions 31 of the tools 3 mounted on the tool-mounting rod 21, keeping the tools 3 spaced apart by placing the washers 210 between each inner wall of the grips 2 and the outmost tools 3, and between every two adjacent tools 3. Then, mount the spring 45 on one of the projecting bars 41 and the washers 46 on the projecting bars 41. Next, insert the other projecting bar 41 into the through hole 22 of the other grip 2. Finally, screw the nuts N at the ends of the connecting rods 20 and tool-mounting rod 21 to keep the grips 2 fixed together.

Figure 4:
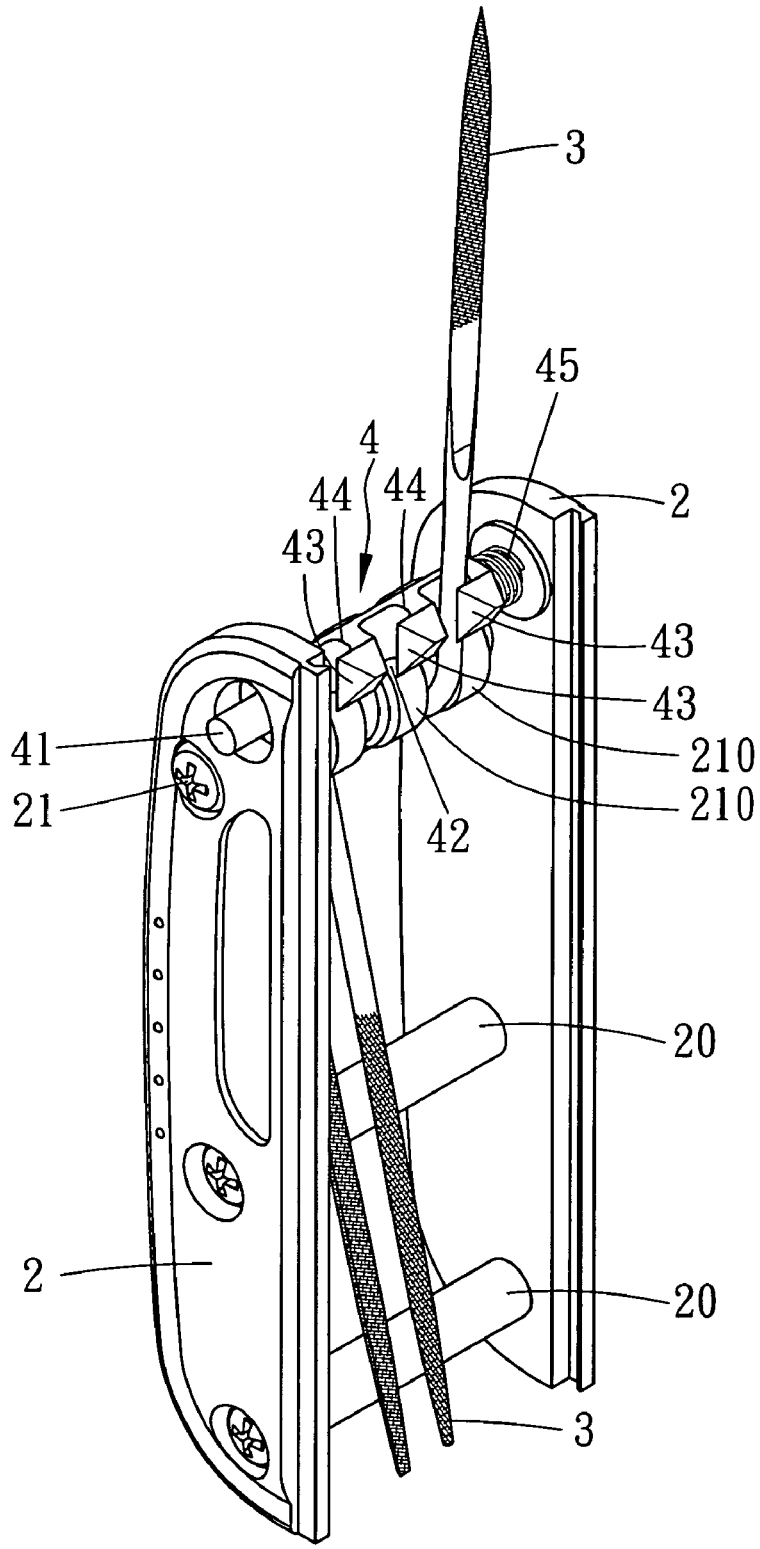
FIG. 4 is a perspective view of the preferred embodiment of a tool set in the present invention, showing it being operated in one way.
Figure 5:
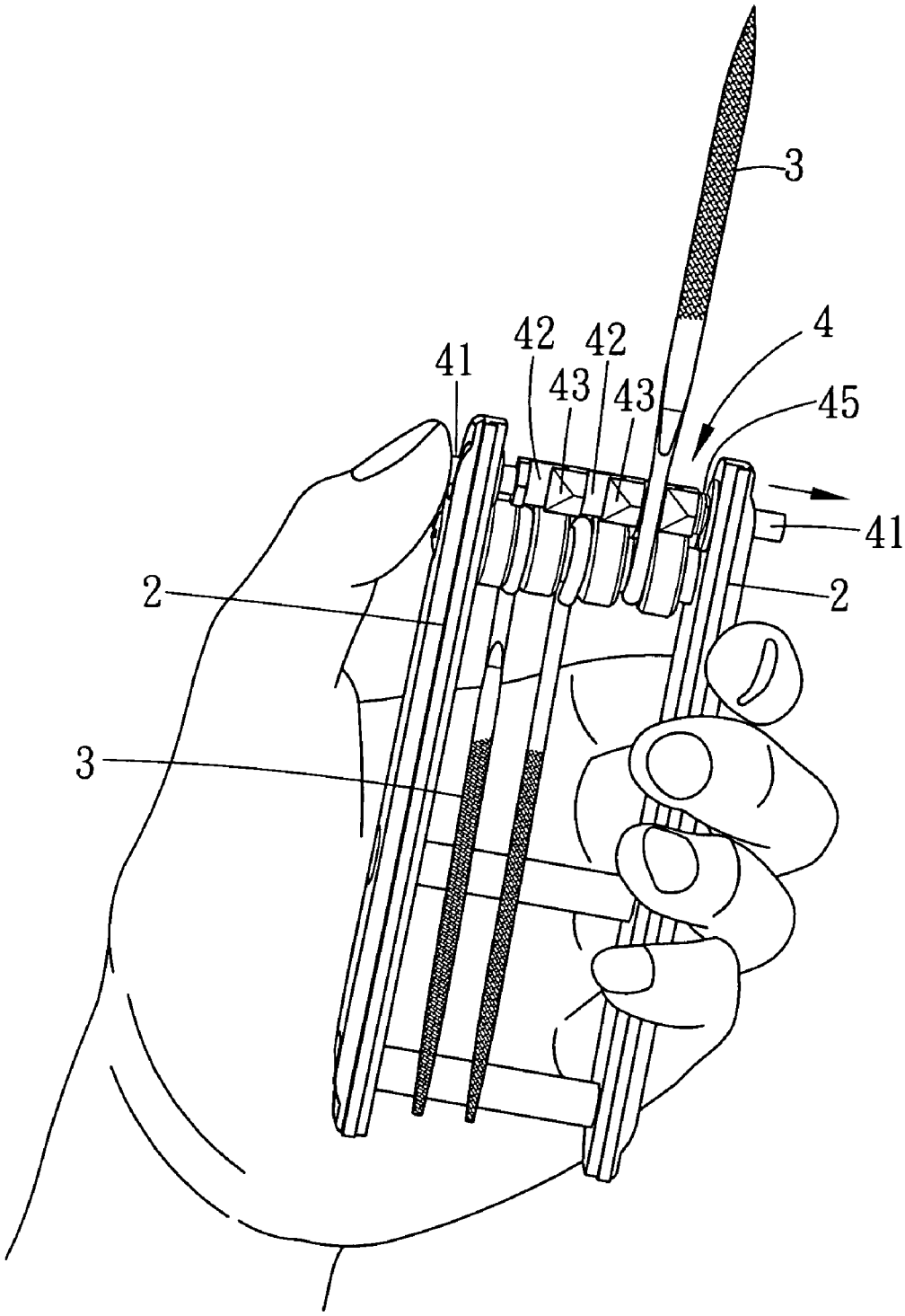
FIG. 5 is a perspective view of the preferred embodiment of a tool set in the present invention, showing it being operated in another way.

In using, as shown in FIGS. 3~5, choose a tool 3 and swing it up to lean on the slope 43 of the positioning member 4. Next, press down the tool 3 to move against the slope 43 to enter the restricting groove 44 through the jag 42. By the time, the spring 45 is to elastically force the positioning member 4 to move back to its original position, keeping the tool 3 remained immovably in the restricted groove 44 of the positioning member 4. So, the tool 3 can be operated stably to prevent a user's hand from being hurt.

As shown in FIGS. 3~5, when the invention is to be stored away, it needs only to press the projecting bar 41 of the positioning member 4 to squeeze the spring 45 until the jag 42 faces exactly to the tool 3, so that the tool 3 can be easily moved back to the grips 2. Therefore, the invention is not only easy to be assembled, but also convenient for carrying around.

Figure 6:
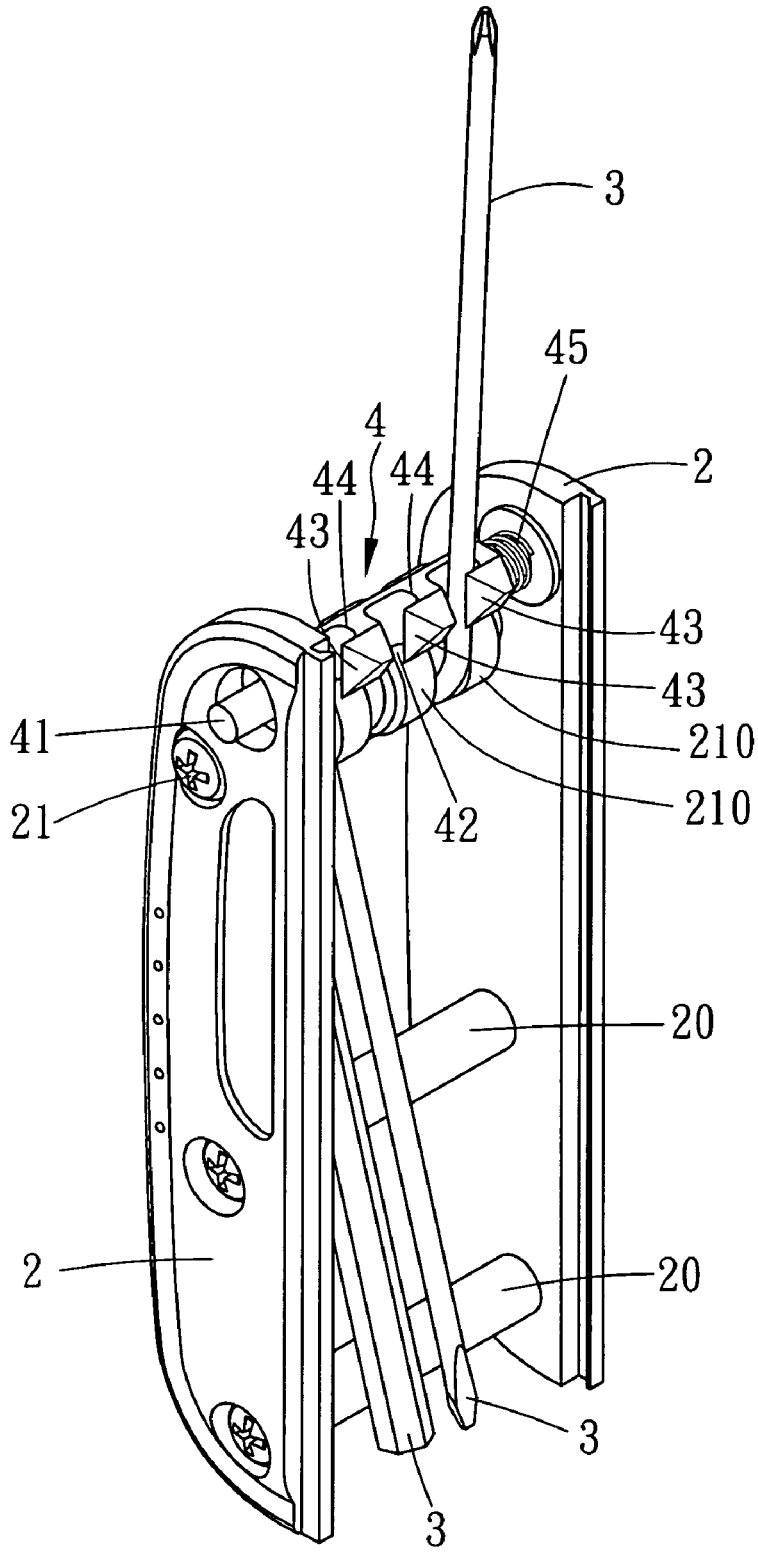
FIG. 6 is a perspective view of the preferred embodiment of a tool set in the present invention, showing it being assembled with a group of different tools (1); and, FIG. 7 is a perspective view of the preferred embodiment of a tool set in the present invention, showing it being assembled with another group of different tools.
Figure 7:
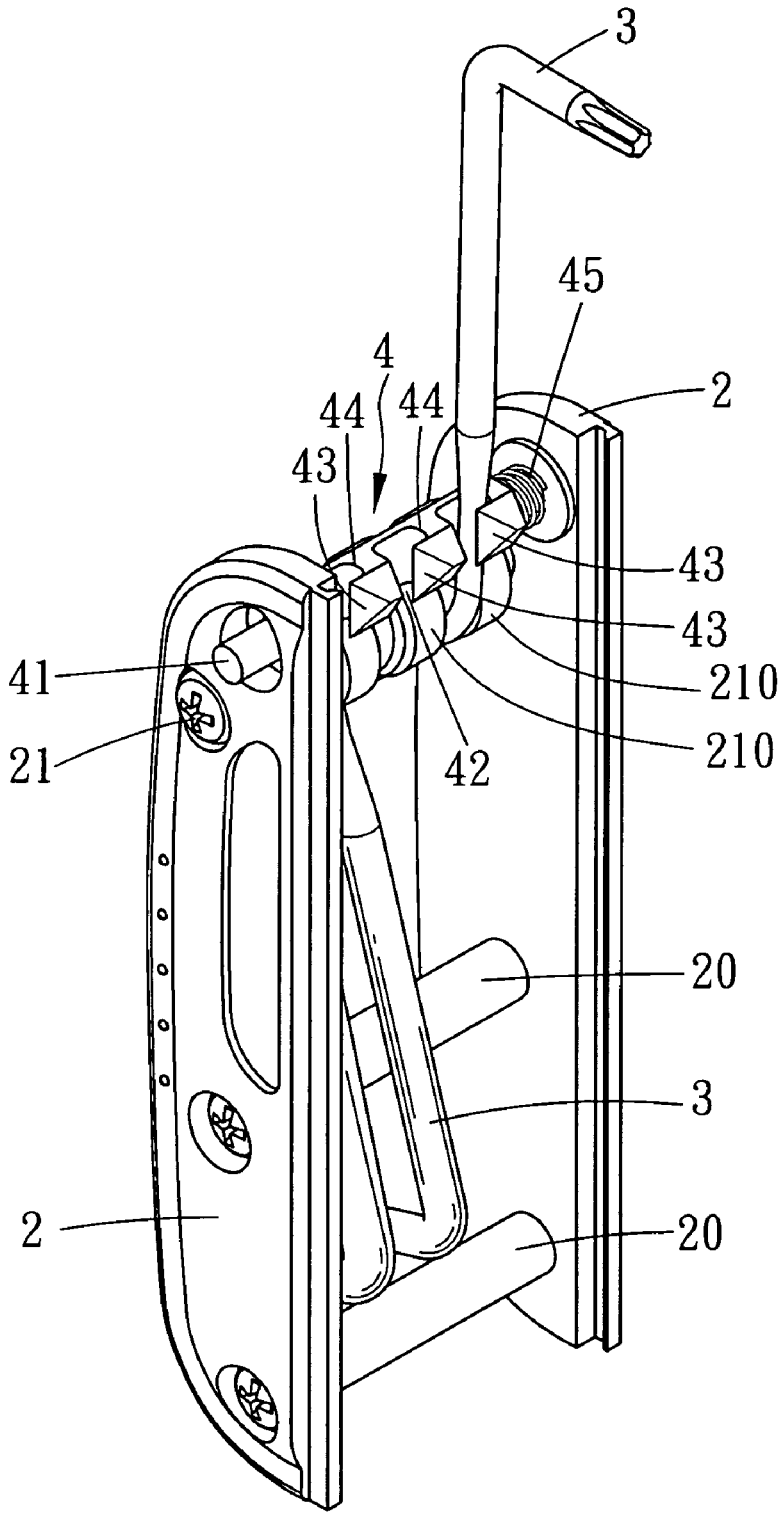

Additionally, the tools 3 can be composed of a variety of assorted ones, as shown in FIGS. 6 and 7.

While the preferred embodiment of the invention has been described above, it will be recognized and understood that various modifications may be made therein and the appended claims are intended to cover all such modifications that may fall within the spirit and scope of the invention.

What is claimed is:

1. A tool set comprising:

two grips spaced apart by connecting a tool-mounting rod that is pivotally mounted with plural different tools, each of said grips provided with a through hole at an upper side thereof;

a positioning member pivotally installed between said grips and each of two opposite ends of said positioning member being provided with a projecting bar for fitting in said through holes, said positioning member further having a plurality of jags, a slope being located in front of each of said jags and a restricting groove being recessed rightward from each of said jags, one of said projecting bars being mounted with a spring; and wherein said tool-mounting rod serves to hang said tool; then said tool can be swung upwards to lean on said slope of said positioning member and next, pressing down said tool to move against said slope to enter said restricting groove through said jag, then said spring elastically forcing said positioning member to move back to its original position to keep said tool remained immovably in said restricted groove to be operated steadily and safely.

2. A tool set as claimed in claim 1, wherein said grips are also separated by two connecting rods fixed via screwing with nuts N.

3. A tool set as claimed in claim 1, wherein each of said tools is provided with a pivotal connecting portion at its one end.

4. A tool set as claimed in claim 1, wherein said tool-mounting rod is provided with plural washers respectively placed between said grips and said tools placed outermost, and between every two adjacent said tools.

5. A tool set as claimed in claim 1, wherein said projecting bars of said positioning member are respectively mounted with a washer additionally between the two grips.

* * * * *